US006895632B2

(12) United States Patent
Murray

(10) Patent No.: US 6,895,632 B2
(45) Date of Patent: May 24, 2005

(54) HAND HELD VACUUM WITH ARCUATE GLIDING SURFACE

(75) Inventor: Christopher J. Murray, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 373 days.

(21) Appl. No.: 10/175,336

(22) Filed: Jun. 19, 2002

(65) Prior Publication Data

US 2003/0233726 A1 Dec. 25, 2003

(51) Int. Cl.[7] ..... A47L 5/24; A47L 11/30
(52) U.S. Cl. ..... 15/344; 15/320
(58) Field of Search ..... 15/320, 322, 344; 392/402–406; D32/21, 22, 24

(56) References Cited

U.S. PATENT DOCUMENTS

| | | | |
|---|---|---|---|
| 2,020,120 | A | 11/1935 | Leathers |
| 2,617,138 | A | 11/1952 | Brown, Sr. et al. |
| 3,040,362 | A | 6/1962 | Krammes |
| 3,245,160 | A | 4/1966 | Knapp |

(Continued)

FOREIGN PATENT DOCUMENTS

JP 2-191498 A 7/1990

OTHER PUBLICATIONS

Black & Decker Home Products Catalog; 1999; 6 Pages.

*Primary Examiner*—Terrence R. Till

(74) *Attorney, Agent, or Firm*—Harness, Dickey & Pierce, P.L.C.

(57) ABSTRACT

A hand held vacuum with a housing having a handle adapted to enable a user to manually adjust an angle of contact between the hand held vacuum and the surface being cleaned is provided. An arcuate gliding surface is associated with the housing and adapted to contact and glide over the surface being cleaned. A fluid discharge aperture associated with the arcuate gliding surface is adapted to discharge fluid adjacent the surface being cleaned. The arcuate gliding surface is adapted to selectively locate the fluid discharge aperture in a position in contact with the surface being cleaned and in a position away from the surface being cleaned by altering the angle of the hand held vacuum while maintaining the arcuate gliding surface in contact against the surface being cleaned.

29 Claims, 3 Drawing Sheets

U.S. PATENT DOCUMENTS

| | | | | | |
|---|---|---|---|---|---|
| 3,604,037 | A | | 9/1971 | Varner | |
| 3,675,449 | A | | 7/1972 | Bluestein | |
| RE27,792 | E | | 10/1973 | Howerin et al. | |
| D231,658 | S | | 5/1974 | Stauft | |
| 3,869,749 | A | | 3/1975 | London et al. | |
| 3,940,826 | A | | 3/1976 | Phillips et al. | |
| 3,949,499 | A | | 4/1976 | Schaeffer et al. | |
| 4,046,989 | A | | 9/1977 | Parise et al. | |
| 4,327,459 | A | | 5/1982 | Gilbert | |
| 4,397,057 | A | | 8/1983 | Harbeck | |
| 4,536,914 | A | | 8/1985 | Levine | |
| 4,583,260 | A | | 4/1986 | Zai | |
| D289,576 | S | | 4/1987 | Okada et al. | |
| 4,656,763 | A | | 4/1987 | Kawasaki et al. | |
| 4,788,769 | A | | 12/1988 | Maruyama | |
| 4,821,366 | A | | 4/1989 | Levine | |
| 4,831,685 | A | | 5/1989 | Bosyj et al. | |
| RE33,074 | E | | 10/1989 | Levine | |
| 4,896,396 | A | | 1/1990 | Giannelli | |
| 4,920,608 | A | | 5/1990 | Hult et al. | |
| 4,928,347 | A | | 5/1990 | Krasznai et al. | |
| D313,831 | S | | 1/1991 | Gildersleeve | |
| 5,020,187 | A | | 6/1991 | Kosten et al. | |
| 5,065,473 | A | | 11/1991 | Krasznai et al. | |
| D333,891 | S | | 3/1993 | Reed, Jr. et al. | |
| 5,289,610 | A | | 3/1994 | Monson | |
| 5,341,541 | A | | 8/1994 | Sham | |
| D352,807 | S | | 11/1994 | Sanderud | |
| 5,367,740 | A | | 11/1994 | McCray | |
| 5,383,251 | A | | 1/1995 | Whitaker et al. | |
| D357,772 | S | | 4/1995 | Yuen | |
| 5,473,792 | A | | 12/1995 | Kent et al. | |
| 5,500,977 | A | | 3/1996 | McAllise et al. | |
| 5,507,068 | A | * | 4/1996 | Fan et al. | 15/320 |
| 5,680,810 | A | | 10/1997 | Sham | |
| 5,692,315 | A | | 12/1997 | Sham | |
| 5,784,753 | A | | 7/1998 | Kaczmarz et al. | |
| 5,784,755 | A | | 7/1998 | Karr et al. | |
| 5,794,303 | A | | 8/1998 | Sanfilippo et al. | |
| 5,819,364 | A | | 10/1998 | Sham | |
| 5,839,159 | A | | 11/1998 | Karr et al. | |
| 5,865,104 | A | | 2/1999 | Sham et al. | |
| 5,896,617 | A | | 4/1999 | Kasen et al. | |
| 5,926,910 | A | | 7/1999 | Nishimura et al. | |
| 5,958,113 | A | | 9/1999 | Collins et al. | |
| 5,970,572 | A | | 10/1999 | Thomas | |
| 6,031,969 | A | | 2/2000 | Burr et al. | |
| D425,270 | S | | 5/2000 | Zahuranec | |
| 6,076,228 | A | * | 6/2000 | Aiken | 15/320 |
| D430,365 | S | | 8/2000 | Roberts et al. | |
| 6,100,502 | A | | 8/2000 | Sham et al. | |
| 6,125,498 | A | | 10/2000 | Roberts et al. | |
| 6,148,144 | A | | 11/2000 | Milanese | |
| 6,189,178 | B1 | | 2/2001 | Roberts | |
| 6,212,332 | B1 | | 4/2001 | Sham et al. | |
| D441,508 | S | | 5/2001 | Doria | |
| D445,974 | S | | 7/2001 | Stratford | |
| 6,289,551 | B1 | | 9/2001 | Basile | |
| 6,314,972 | B1 | | 11/2001 | Sin | |
| 6,658,693 | B1 | * | 12/2003 | Reed, Jr. | 15/321 |
| 2001/0039684 | A1 | | 11/2001 | Kasper et al. | |

* cited by examiner

HAND HELD VACUUM WITH ARCUATE GLIDING SURFACE

FIELD OF THE INVENTION

The present invention relates to hand held vacuums; and more particularly, to such vacuums which utilize a fluid to enhance cleaning.

BACKGROUND OF THE INVENTION

Hand held vacuums which utilize a fluid, such as a liquid cleaning fluid or steam, to enhance cleaning are known. Many of these known vacuums dispense the fluid from apertures which are maintained some distance away from the surface to be cleaned. Such a configuration does not foster maximum take-up of the fluid by the surface being cleaned. This is particularly true where a fluid vapor, such as steam is being used as the cleaning fluid.

As an example, at least one known hand held vacuum utilizes rotating wheels which contact and roll along the surface being cleaned. As discussed above, these wheels maintain the fluid dispensing apertures some distance from the surface being cleaned. Although the wheels rotate, they provide a very small contact area which can increase the force required to push the vacuum over the surface being cleaned; particularly if the surface is a plush material. In addition, debris from the surface tends to be picked up by the rotating wheels where it can become entangled in the wheel components; leading to an unsightly situation which is difficult to clean.

Other known hand held vacuums have a substantially flat surface in which the vacuum inlet is included. Fluid dispensing apertures may also be located in this substantially flat surface. Such surfaces tend to join with an adjacent substantially flat surface of the vacuum housing at a fairly large angle. Although the surfaces at the point of joinder may be radiused, the radius is typically small. Thus, a rather small area would be in contact with the surface being cleaned if the angle of the vacuum were lowered during operation to ride on the radiused area. When such a small radiused contact area is provided, the force required to push the vacuum over the surface being cleaned is generally increased.

SUMMARY OF THE INVENTION

In one aspect of the present invention a hand held vacuum which uses a fluid to enhance cleaning of a surface is provided. Included is a housing having a handle adapted to enable a user to manually adjust an angle of contact between the hand held vacuum and the surface being cleaned. An arcuate gliding surface is associated with the housing and adapted to contact and glide over the surface being cleaned. A fluid discharge aperture located in the arcuate gliding surface is adapted to discharge fluid adjacent the surface being cleaned. A vacuum inlet associated with the housing is adapted to receive debris being vacuumed from the surface being cleaned.

In another aspect of the present invention a hand held vacuum which uses a fluid to enhance cleaning of a surface is provided in which a fluid discharge aperture is associated with the arcuate gliding surface. The fluid discharge aperture is adapted to discharge fluid adjacent the surface being cleaned. The arcuate gliding surface is adapted to selectively locate the fluid discharge aperture in a position in contact with the surface being cleaned and in a position away from the surface being cleaned by altering the angle between the hand held vacuum and the surface being cleaned while maintaining the arcuate gliding surface in contact against the surface being cleaned In another aspect of the present invention a hand held vacuum which uses a fluid to enhance cleaning is provided which an arcuate surface is associated with the housing. The arcuate surface is delimited by the initiation of a radius of less than about 30 millimeters and is adapted to enable an angle between the hand held vacuum and the surface being cleaned to be altered at least about 10 degrees while maintaining the arcuate gliding surface in contact against the surface being cleaned.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. For example, although the invention is discussed herein in terms of a hand held steam vacuum, it could also be used, e.g., with other liquids which enhance cleaning.

Figure 1:
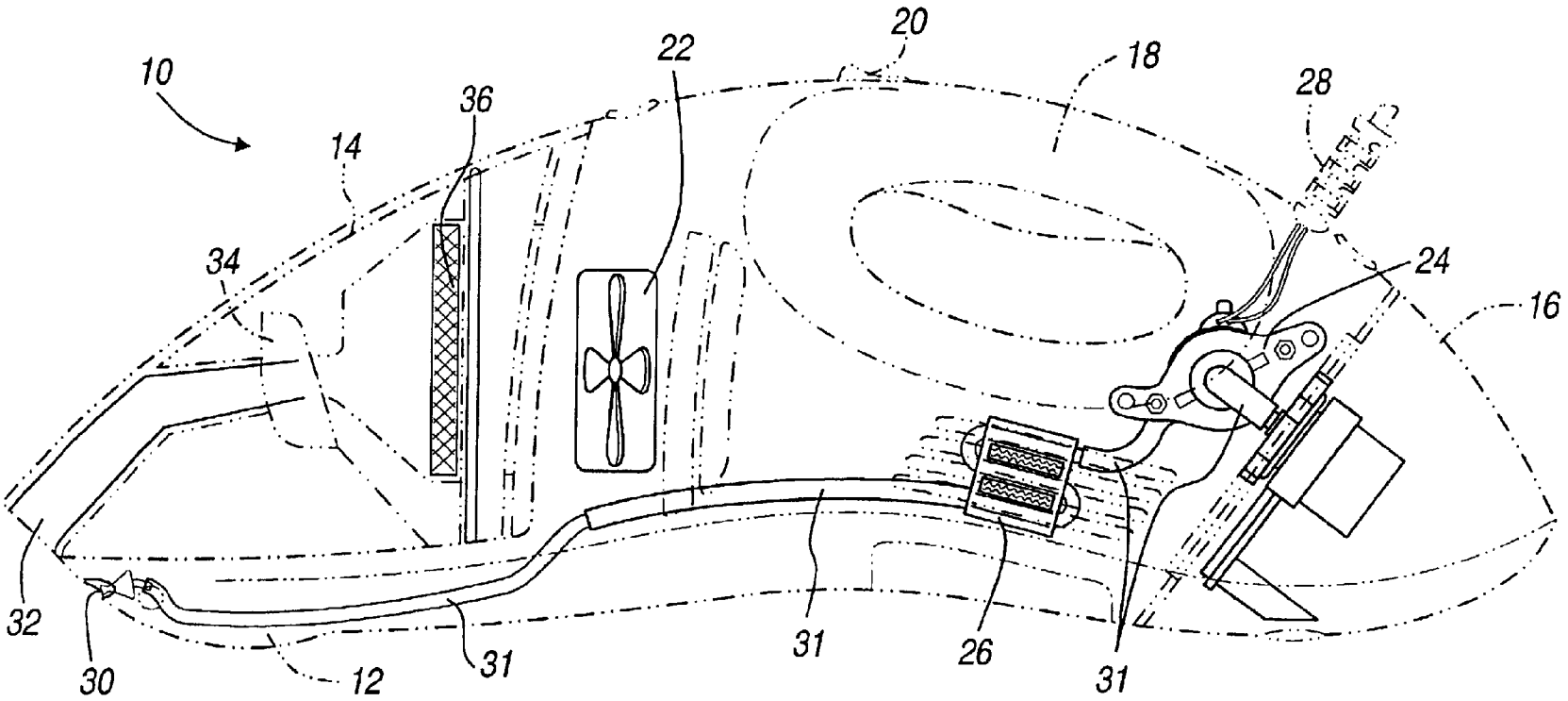
FIG. 1 is a perspective illustration including various of the major components of a preferred hand held vacuum of the present invention.

Referring to FIG. 1, preferred embodiment of a hand held steam vacuum, generally indicated as 10, is illustrated. The hand held steam vacuum generally includes a housing 12 to which a collection bowl 14 and a liquid supply tank 16 is attached. The housing 12 includes a handle 18 and a switch 20. Internal to the housing 12 is a fan 22, a pump mechanism 24, and a heater element 26, all selectively electrically connected to power supply cord 28 via switch 20. Liquid is pumped by the pump mechanism 24 from the liquid supply tank 16 through the heating element 26 and out through discharge openings 30 through fluid transport tubes 31.

The debris collection bowl 14 is removably attached to the housing 12 and includes a vacuum inlet 32, a deflector 34, and a filter element 36. In operation, a fan 22 sucks air, liquid and debris into the collection bowl 14 through the vacuum inlet 32. These incoming materials impact upon the deflector 34 which generally separates the liquid and debris from the air which passes through the filter 36 and out of the housing 12.

Figure 2:
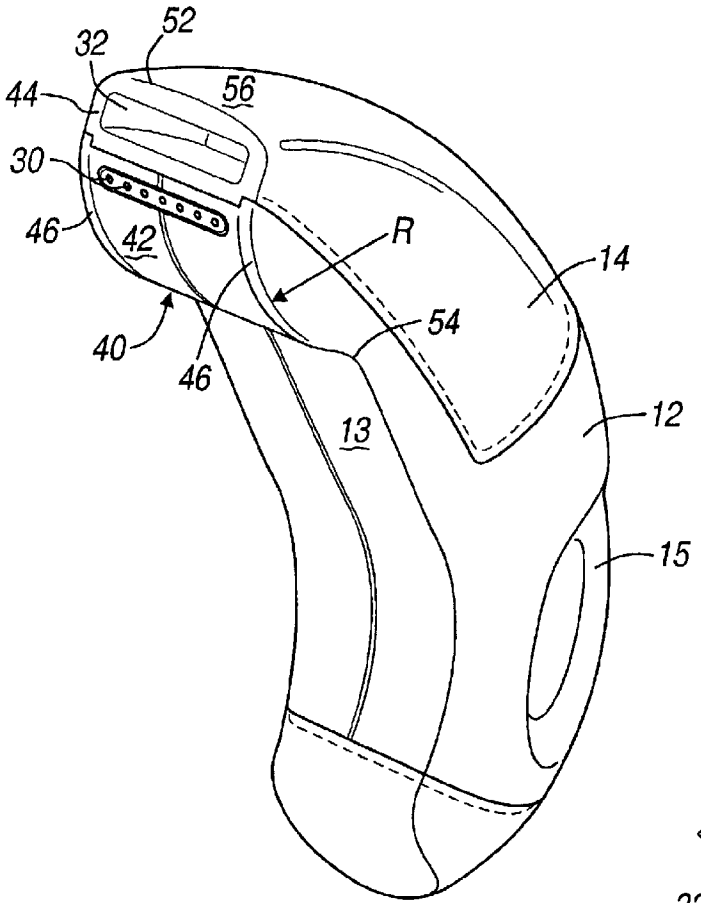
FIG. 2 is a perspective view showing the arcuate gliding surface of the hand held vacuum of FIG. 1.
Figure 4:
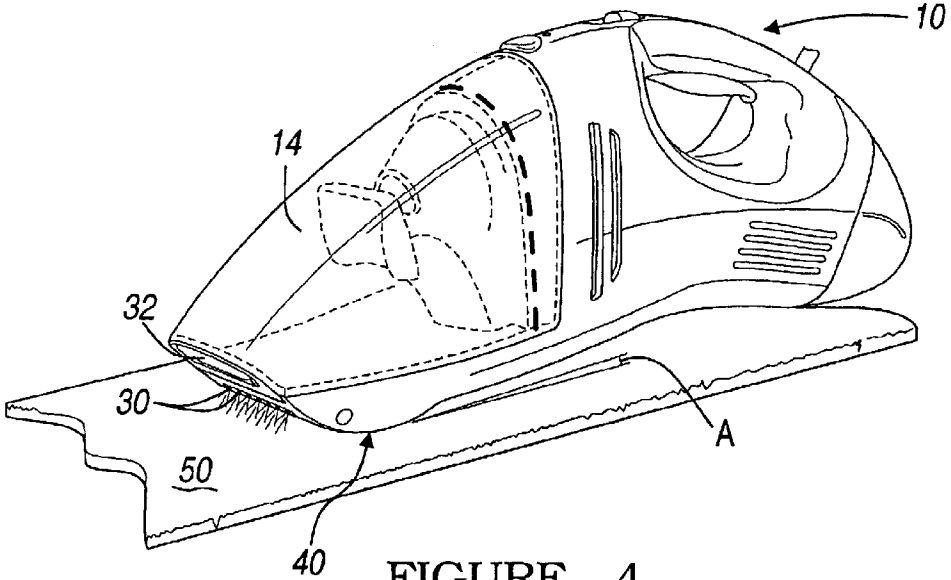
FIG. 4 is a perspective view showing the hand held vacuum of FIG. 1 being operated at a relatively small angle with respect to a surface being cleaned.
Figure 5:
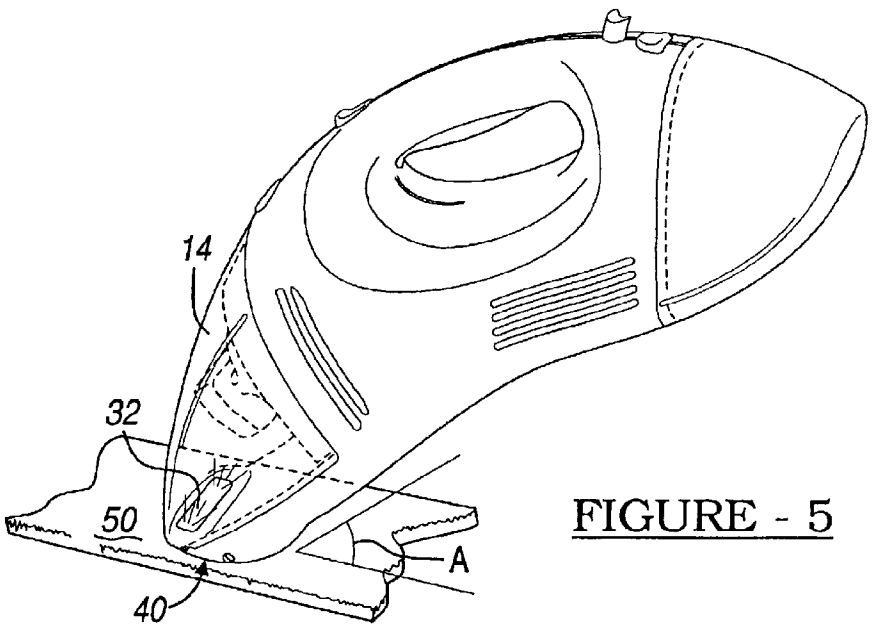
FIG. 5 is a perspective view showing the hand held vacuum of FIG. 1 being operated at a relatively large angle with respect to a surface being cleaned.

Referring to FIG. 2, housing 12 includes a handle 15 and an arcuate gliding surface 40 which contacts the surface to be cleaned 50 (shown in FIG. 4 and FIG. 5). The arcuate gliding surface 40 extends to include a portion of the debris collection bowl 14 surrounding the vacuum inlet 32. Thus, the arcuate surface 40 of this preferred embodiment includes the opening for vacuum inlet 32 and a plurality of fluid discharge apertures 30.

The arcuate surface 40 is delimited by the initiation of any small radius providing a visual transition between two adjacent surfaces. The arcuate surface 40 is delimited by the initiation of the slightly raised longitudinal edges 46, each having a small radius. The arcuate surface is also delimited by the initiation of transverse edges 52, 54. Transverse edge 52 begins at the initiation of the small convex radius joining surface 44 with surface 56. Transverse edge 52 (also seen in FIG. 3) begins at the initiation of the small concave radius joining surface 42 with bottom surface 13. In each case, the small radius provides a clear visual transition between the two surfaces.

Similarly, prior art devices (not shown) have often included two substantially flat surfaces joined together along a small radiused transition segment. This small radiused transition segment provides a clear visual transition between these two substantially flat surfaces. As indicated above, the arcuate surface is delimited by the initiation of such small radius surfaces. Thus, the initiation of such small radiused surfaces 46, 52, 54 defines the external edges of the arcuate surface 40. Preferably, the small radius of the surface delimiting the exterior edge of the arcuate surface 40 is one which is less than about 30 millimeters; more preferably, less than about 20 millimeters; and even more preferably, less than about 10 millimeters.

The arcuate surface 40, however, may include small recessed radiused surfaces which transition into openings within these external edges of the arcuate surface 40. Such recessed radii typically do not meaningfully affect the gliding function of the arcuate surface. Similarly, although not preferred, the arcuate surface 40 may include small raised features with small radii that do not meaningfully affect the gliding function of the arcuate surface. Preferably, any such small raised features have a height from the surrounding arcuate surface of less than about 1 millimeter; and more preferably less than about 0.5 millimeter. Preferably, any such raised feature has a radius of at least about 0.5 millimeter; and more preferably, at least about 1 millimeter.

Figure 3:
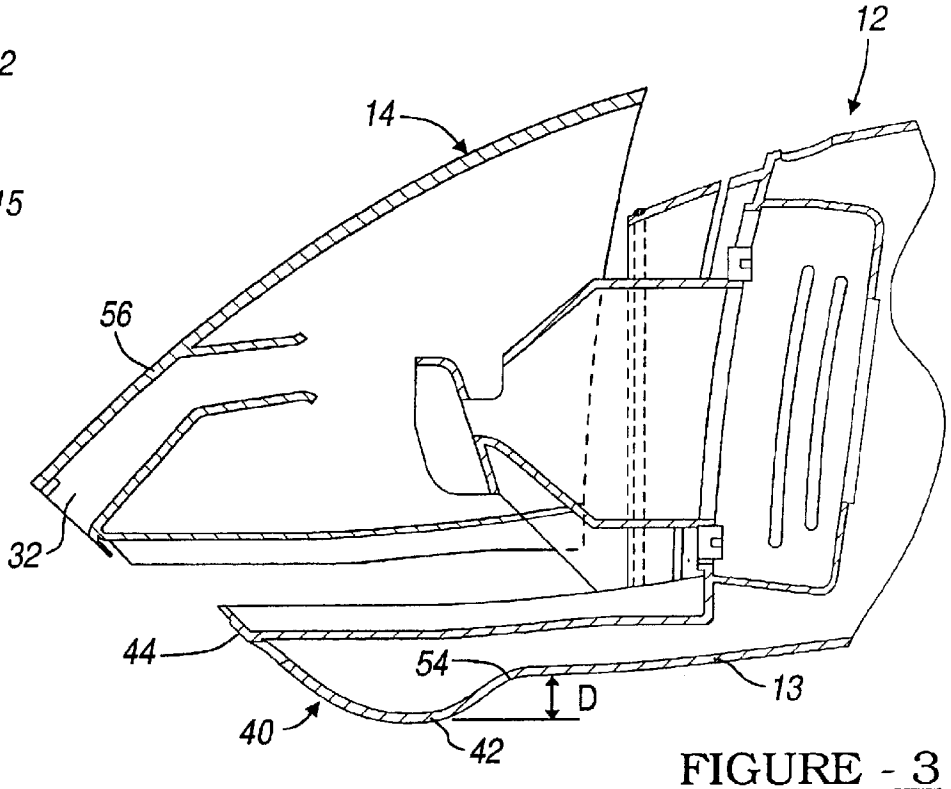
FIG. 3 is a partial cross sectional view through the arcuate gliding surface.

Referring to FIG. 3, the arcuate surface 40 has a segment 42 which has a relatively large convex radius R and transitions to a substantially flat segment 44 in the area of the vacuum inlet 32. This surface 40 is considered arcuate, although it includes a flat or substantially flat segment 44, since it also includes a radiused segment 42. The arcuate surface 40 preferably has a convex radius R which is at least about 40 millimeters; more preferably, at least about 50 millimeters; and even more preferably, at least about 70 millimeters. Increasing the convex radius of the arcuate surface 40 provides greater surface area against the surface being cleaned which reduces the contacting pressure; particularly where the surface 50 being cleaned is a soft or plush surface like carpet.

The transition from the radiused segment 42 of the arcuate surface 40 to the substantially flat segment 44 of the arcuate surface 40 is preferably smooth; resulting in no visual feature marking the transition between the two segments 42, 44. Moreover, the arcuate surface 40 preferably has no transition or joinder of surfaces which utilizes a small radius. As used herein the term "small radius" includes sharp edges without any radius.

In addition, the surface material of the arcuate gliding surface 40 preferably has a low coefficient of friction. It is also worth noting that there are preferably no moving parts associated with arcuate surface 40 which contact the surface 50 being cleaned. Since the coefficient of friction is low and there are no moving parts associated with the arcuate gliding surface 40, debris is less likely to become attached to the arcuate gliding surface 40. Any dirt or debris which clings to the surface 40 is easily removed by simply wiping the arcuate gliding surface clean.

With continuing reference to FIG. 3, the arcuate gliding surface 40 of this embodiment extends downwardly, some distance D past the adjacent lower surface 13 of the housing 12. Preferably, the arcuate gliding surface 40 extends a distance D at least about 2 millimeters below the adjacent lower surface 13 of the housing 12; more preferably about 3 millimeters; and even more preferably, about 3.5 millimeters. In addition, the joinder between the arcuate gliding surface 40 and the adjacent lower surface 13 of the housing 12 preferably occurs along a surface 54 with a concave radius. Each of these preferred arrangements enable the joinder of the arcuate surface 40 with the adjacent housing 12 surfaces without creating a small radius segment which contacts the surface 50 being cleaned.

Referring to FIG. 4, the vacuum 10 is being held with the arcuate gliding surface 40 against the surface 50 being cleaned and at an angle A with respect to the surface 50 being cleaned which is relatively small. In this position against the surface 50 being cleaned and at this angle, the fluid discharge apertures 30 are maintained adjacent the surface 50 being cleaned in a position a slight distance away from the surface 50 being cleaned. Thus, steam and/or liquid is discharged from the fluid discharge apertures 30 adjacent the surface 50 being cleaned. Steam and/or liquid being discharged from the fluid discharge apertures 30 of the vacuum 10 travels a short distance before being deposited on the surface 50 being cleaned. In this position, the vacuum inlet 32 is located in a position which is even further away from the surface 50 being cleaned. Thus, the vast majority of this fluid discharged from fluid discharge aperture 30 is permitted to remain on the surface 50 being cleaned for some period of time, since the vacuum inlet 32 is not located in a position where it is very effective at vacuuming up the fluid.

Referring to FIG. 5, the vacuum 10 is being held with the arcuate gliding surface 40 against the surface 50 being cleaned and at an angle A with respect to the surface being cleaned which is relatively large. At the illustrated angle, both the fluid discharge apertures 30 and the vacuum inlet 32 are adjacent the surface 50 being cleaned and in a position where they are in direct contact with the surface being cleaned. Thus, as the hand held vacuum is pushed forward, away from the user, steam and/or liquid is deposited adjacent to the surface 50 being cleaned by being directly deposited on the surface 50 being cleaned. In addition, debris is vacuumed into the debris collection bowl 14. Similarly, as a hand held a vacuum 10 is pulled back toward the user, debris and fluid which has previously been discharged is vacuumed into the debris collection bowl 14.

Comparing FIG. 4 and FIG. 5, it can be understood that the during use the arcuate gliding surface 40 is in contact against the surface 50 being cleaned. Various contact angles can be used to accomplish various effects. The arcuate gliding surface 40 is preferably adapted to enable an angle A between the hand held vacuum 10 and the surface 50 being cleaned to be altered while maintaining the arcuate gliding surface 40 in contact against the surface 50 being cleaned at least about 10 degrees; more preferably, at least about 25 degrees; and even more preferably, at least about 40 degrees.

The arcuate gliding surface 40 also preferably has a longitudinal length which is sufficient to enable contact against the surface 50 being cleaned throughout the preferred range of degrees indicated above. To be clear, the arcuate gliding surface 40 is not in contact against the surface 50 being cleaned when the primary contacting point is one of the small radiused surface delimiting the external edges of the arcuate gliding surface 40, since surfaces having such a small radius are outside the limit of the arcuate gliding surface 40 as previously indicated.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A hand held vacuum which uses a fluid to enhance cleaning of a surface, comprising:

a housing having a handle adapted to enable a user to manually adjust the angle of contact between the hand held vacuum and the surface being cleaned;

an arcuate gliding surface associated with the housing and adapted to contact and glide over the surface being cleaned;

a fluid discharge aperture located in the arcuate gliding surface adapted to discharge fluid adjacent the surface being cleaned; and a vacuum inlet associated with the housing and adapted to receive debris being vacuumed from the surface being cleaned.

2. A hand held vacuum according to claim 1, further comprising a heating mechanism adapted to heat the fluid prior to the fluid exiting the fluid discharge aperture.

3. A hand held vacuum according to claim 2, wherein the fluid comprises liquid water and the heating mechanism converts at least a portion of the liquid water to a water vapor.

4. A hand held vacuum according to claim 2, wherein the arcuate gliding surface has a convex radius of at least about 30 millimeters.

5. A hand held vacuum according to claim 1, wherein the vacuum inlet is located in the arcuate gliding surface.

6. A hand held vacuum according to claim 1, wherein altering an angle of contact between the hand held vacuum and the surface being cleaned moves the fluid discharge apertures between a position where the fluid discharge apertures are in contact with the surface being cleaned and a position where the fluid discharge apertures are not in contact with the surface being cleaned.

7. A hand held vacuum according to claim 1, wherein a portion of the arcuate gliding surface extends down a distance from a bottom wall of the housing at least about 2 millimeters.

8. A hand held vacuum according to claim 1, wherein the arcuate gliding surface has a convex radius of at least about 40 millimeters.

9. A hand held vacuum according to claim 1, wherein the arcuate gliding surface has a convex radiused segment with a radius of at least about 40 millimeters which transitions to a substantially flat segment.

10. A hand held vacuum according to claim 1, wherein a length of the arcuate gliding surface is sufficient to enable contact against the surface being cleaned throughout an angle of at least about 10 degrees.

11. A hand held vacuum which uses a fluid to enhance cleaning of a surface, comprising:

a housing having a handle adapted to enable a user to manually adjust an angle of contact between the hand held vacuum and the surface being cleaned;

an arcuate gliding surface associated with the housing and adapted to contact and glide over the surface being cleaned;

a fluid discharge aperture associated with the arcuate gliding surface and adapted to discharge fluid adjacent the surface being cleaned; and wherein the arcuate gliding surface is adapted to selectively locate the fluid discharge aperture in a position in contact with the surface being cleaned and in a position away from the surface being cleaned by altering the angle between the hand held vacuum and the surface being cleaned while maintaining the arcuate gliding surface in contact against the surface being cleaned.

12. A hand held vacuum according to claim 11, further comprising a heating mechanism adapted to heat the fluid prior to the fluid exiting through the fluid discharge aperture.

13. A hand held vacuum according to claim 12, wherein the fluid comprises liquid water and the heating mechanism converts at least a portion of the liquid water to a water vapor.

14. A hand held vacuum according to claim 12, wherein the arcuate gliding surface has a convex radius of at least about 40 millimeters.

15. A hand held vacuum according to claim 12, wherein a length of the arcuate gliding surface is sufficient to enable contact against the surface being cleaned throughout an angle of at least about 10 degrees.

16. A hand held vacuum according to claim 11, further comprising a vacuum inlet located in the arcuate gliding surface.

17. A hand held vacuum according to claim 11, wherein a portion of the arcuate gliding surface extends down a distance from a bottom wall of the housing at least about 2 millimeters.

18. A hand held vacuum according to claim 11, wherein the arcuate gliding surface has a convex radius of at least about 40 millimeters.

19. A hand held vacuum according to claim 11, wherein the arcuate gliding surface has a convex radiused segment with a radius of at least about 40 millimeters which transitions to a substantially flat segment.

20. A hand held vacuum according to claim 11, wherein a length of the arcuate gliding surface is sufficient to enable contact against the surface being cleaned throughout an angle of at least about 10 degrees.

21. A hand held vacuum which uses a fluid to enhance cleaning of a surface, comprising:

a housing having a handle adapted to enable a user to manually adjust the angle of contact between the hand held vacuum and the surface being cleaned;

an arcuate surface associated with the housing, the arcuate surface being delimited by the initiation of any radius of less than about 30 millimeters and being adapted to enable the angle between the hand held vacuum and the surface being cleaned to be altered at least about 10 degrees while maintaining the arcuate gliding surface in contact against the surface being; and a vacuum inlet located in the arcuate gliding surface.

22. A hand held vacuum according to claim 21, further comprising a heating mechanism for heating the fluid.

23. A hand held vacuum according to claim 22, wherein the fluid comprises liquid water and the heating mechanism converts at least a portion of the liquid water to a water vapor.

24. A hand held vacuum according to claim 22, further comprising a fluid discharge aperture associated with the arcuate gliding surface.

25. A hand held vacuum according to claim 24, wherein altering the angle of contact between the vacuum and the surface being cleaned moves the fluid discharge aperture from a position where the fluid discharge aperture is in contact with the surface being cleaned to a position where the fluid discharge aperture is not in contact with the surface being cleaned.

26. A hand held vacuum according to claim 21, further comprising a fluid discharge aperture located in the arcuate gliding surface.

27. A hand held vacuum according to claim 26, wherein altering an angle of contact between the vacuum and the surface being cleaned moves the fluid discharge aperture from a position where the fluid discharge aperture is in contact with the surface being cleaned to a position where the fluid discharge aperture is not in contact with the surface being cleaned.

28. A hand held vacuum according to claim 27, further comprising a vacuum inlet located in the arcuate gliding surface.

29. A hand held vacuum according to claim 21, wherein a portion of the arcuate gliding surface extends down a distance from a bottom wall of a housing at least about 2 millimeters.

* * * * *

UNITED STATES PATENT AND TRADEMARK OFFICE

CERTIFICATE OF CORRECTION

PATENT NO. : 6,895,632 B2
DATED : May 24, 2005
INVENTOR(S) : Christopher J. Murray It is certified that error appears in the above-identified patent and that said Letters Patent is hereby corrected as shown below:

Column 6,
Line 66, after "being" insert -- cleaned --.

Signed and Sealed this

First Day of November, 2005

JON W. DUDAS
*Director of the United States Patent and Trademark Office*